United States Patent [19]

Chen

[11] Patent Number: 4,615,523

[45] Date of Patent: Oct. 7, 1986

[54] CHILD'S WALKER WITH HEIGHT ADJUSTMENT APPARATUS

[76] Inventor: Ming-Yaw Chen, 64 Tai Ping Rd., Tai Chung, Taiwan

[21] Appl. No.: 746,557

[22] Filed: Jun. 19, 1985

[51] Int. Cl.[4] ..... A61H 3/00; A47D 13/04

[52] U.S. Cl. ..... 272/70.3; 280/87.02 W; 297/5

[58] Field of Search ..... 272/70.3, 70.4; 280/87.02 W; 297/5, 6, 56; 108/118, 119; 403/107; 38/103

[56] References Cited

U.S. PATENT DOCUMENTS

| | | | |
|---|---|---|---|
| 313,280 | 3/1885 | Bell | 108/119 X |
| 1,982,205 | 11/1934 | Doman | 108/118 X |
| 2,908,984 | 10/1959 | Lantz | 108/118 X |
| 3,532,356 | 10/1970 | Lillibridge | 272/70.3 X |
| 3,884,495 | 5/1975 | Petock | 272/70.3 X |
| 4,019,756 | 4/1977 | Ishida | 280/87.02 W X |
| 4,168,669 | 9/1979 | Arnoff | 108/119 X |
| 4,359,242 | 11/1982 | Gerken et al. | 280/87.02 W X |
| 4,433,869 | 2/1984 | Payne, Jr. et al. | 297/5 |

FOREIGN PATENT DOCUMENTS

| | | | |
|---|---|---|---|
| 1123709 | 9/1956 | France | 38/103 |
| 1482083 | 5/1967 | France | 38/103 |
| 0832913 | 4/1960 | United Kingdom | 272/70.3 |

*Primary Examiner*—Robert A. Hafer
*Assistant Examiner*—Kathleen D'Arrigo
*Attorney, Agent, or Firm*—McGlew and Tuttle

[57] ABSTRACT

The present invention discloses an apparatus for adjusting the height of a walker which includes a seat, a slidable base, and two U-shaped tubes which are pivotally connected to each other in a crosswise arrangement and are placed between the seat and the slidable base with one central portion of one U-shaped tubes pivotally connected to the rear side of the seat, and the other central portion of the other U-shaped tube movably engaged to the underside of the seat near its front side, the adjusting apparatus comprising two plates secured on the underside of the seat in a parallel arrangement, with each plate having an indented portion formed at its underside; two sliding members provided on the movable central portion, and slidably engaged with the plates respectively; a controlling member pivotally connected with the movable central portion, and having an engaging portion, with an operating portion opposite to the engaging portion, and two protuberances extended upwards; and a spring member arranged between the sliding members and the engaging portion of the controlling member for biasing the controlling member to rotate in a direction that causes the protuberances to move upwards to engage with the indented portions respectively.

3 Claims, 5 Drawing Figures

CHILD'S WALKER WITH HEIGHT ADJUSTMENT APPARATUS

BACKGROUND OF THE INVENTION

The present invention relates to an improved apparatus for adjusting the height of a walker in accordance with the height of a child who uses the walker.

The conventional walker is generally designed to be collapsible for easy potability and storage as shown in FIG. 1. The walker utilizes several pair of two-rod legs 1, each pair of two-rod legs 1 is collapsibly jointed together by a collapsible jointing device 2. However, such a walker cannot be adjusted in height for different children or for adapting to the growth of the child who uses the walker. To remove the disadvantage, the manufacturer has proposed two improved walkers which are adjustable in height, and which are respectively shown in FIGS. 2 and 3. With reference to FIG. 2, the height adjusting apparatus for the walker utilizes a rectangular frame 3 secured under the front end of the seat of the walker, having two indented portions 10 formed at its underside. An engaging device 11 includes a retaining block 12 sleeved on one leg frame and positioned above the rectangular frame 3, an engaging member 5 capable of engaging with the indented portions 10 positioned under the rectangular frame 3 and connected to the retaining block 12 by a screw extended through them and the cental slot of the rectangular frame 3. A spring member 4 is arranged between the screw head of the screw and the engaging member 5 for biasing the engaging member 5 to firmly engage with the indented portions 10 and the retaining block 12 to abut against the rectangular frame 3. When one wishes to adjust the height of the walker, first pull the engaging member 5 downwards against the bias force of the spring member 4 to make the engaging device 11 disengage with the rectangular frame 3, so that the leg frame with the engaging device 11 can slide to the desired position along the central slot of the rectangular frame 3, resulting in a desired height for a user. However, such a height adjusting apparatus is inconvenient for a female, who generally nurses a child, to use because to operate the device the user must apply a relatively large amount of force to resist the relatively strong spring which is needed to assure that the engaging device 11 is firmly engaged with the rectangular frame 3.

Referring to FIG. 3, the height adjusting apparatus utilizes two plates 6 secured on the underside of the seat near its front end, and having respective indented portions along their faced sides. Two retaining members 7 are sleeved on the leg frame, and positioned between two plates 6. On the side of each retaining member 7 facing toward the respective indented portion of the respective plate a corresponding indented portion is formed. A spring 8 is also sleeved on the leg frame, and positioned between two retaining members 7 for biasing the two retaining members 7 in respectively opposite directions so as to engage their indented portions with the indented portions of the plates. When operating the height adjusting apparatus, one must push the retaining members 7 inwards to disengage with the plates 6, and then move the leg frame with the retaining members 7 to a desired position, resulting in the desired height for the walker. For assuring firm engagements between the plates and the retaining members 7, a relatively strong spring is normally used. Therefore, it is also inconvenient for a female to operate.

SUMMARY OF THE INVENTION

It is, accordingly, the principal object of the present invention to provide an improved adjusting apparatus for adjusting the height of a walker which facilitates the operation of changing the height while maintaining a high degree of stability for the walker.

A more particular object is to provide an adjusting apparatus for adjusting the height of a walker which includes a seat, a slidable base, and two U-shaped tubes which are pivotally connected each other in a crosswise arrangement and placed between the seat and the slidable base with their ends pivotally connected to the slidable base respectively, one of the central portions of one U-shaped tube being pivotally connected to one side of the seat, while the other central portion of the other U-shaped tube is movably engaged to the underside of the opposite side of the seat, the adjusting apparatus comprising two plates secured on the underside of the opposite side of the seat in a parallel arrangement, with each plate having an indented portion formed at its underside; two sliding members provided on the movable central portion, and slidably engaged with the plates respectively; a controlling member pivotally connected with the movable central portion having an engaging portion with an operating portion opposite to the engaging portion, and two protuberances extended upwards; and a spring member arranged between the sliding members and the engaging portion of the controlling member for biasing the controlling member to rotate in a direction that causes the protuberances to move upwards to engage with the indented portions respectively, and wherein when the operating portion of the controlling member is manually pressed, the controlling member will rotate in the opposite direction so that the protuberances disengage with the indented portions against the bias force of the spring member.

Another object of the present invention is to provide an adjusting apparatus of the character described, wherein the sliding members include a rod connected therebetween for separating the two sliding members with an appropriate distance and for one end of the spring member to secure thereon.

Other objects, features and advantages of the present invention will be apparent from the following description when read with reference to the accompanying drawings.

BRIEF DESCRIPTION OF THE DRAWINGS

In these drawings, wherein like reference numerals denote corresponding parts throughout the several views.

DETAILED DESCRIPTION OF THE PREFERRED EMBODIMENT

Figure 1:
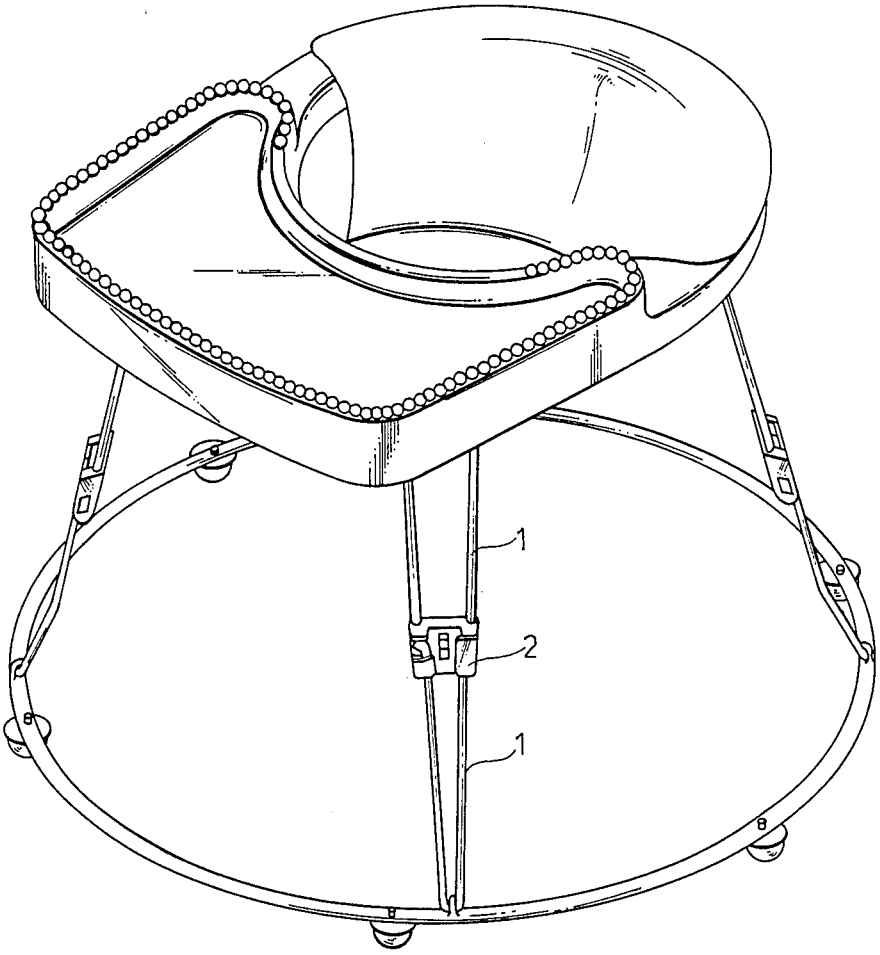
PRIOR ART FIG.1
FIG. 1 is a perspective view of one conventional walker which is adjustable in height.
Figure 2:
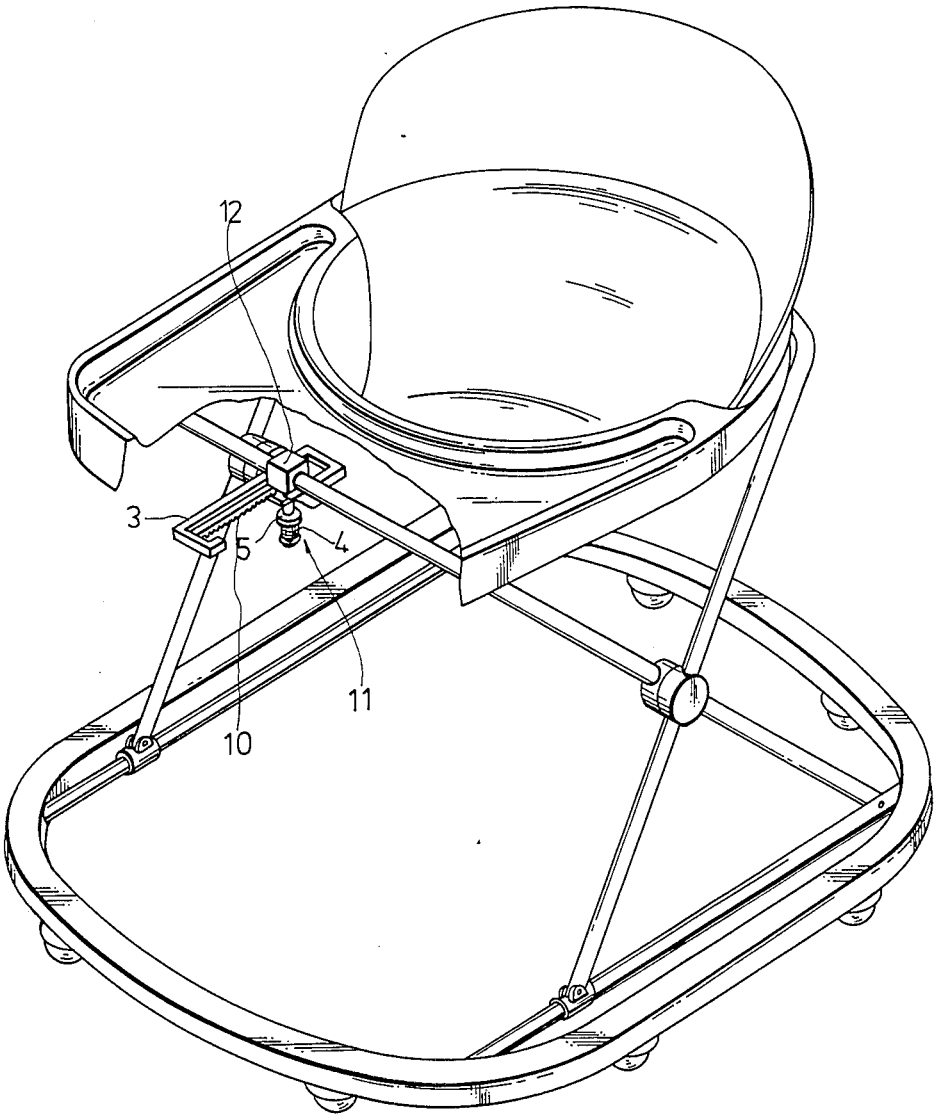
PRIOR ART FIG. 2
FIG. 2 is a perspective view of another conventional walker which is adjustable in height, with portions broken away to reveal constructional details.
Figure 3:
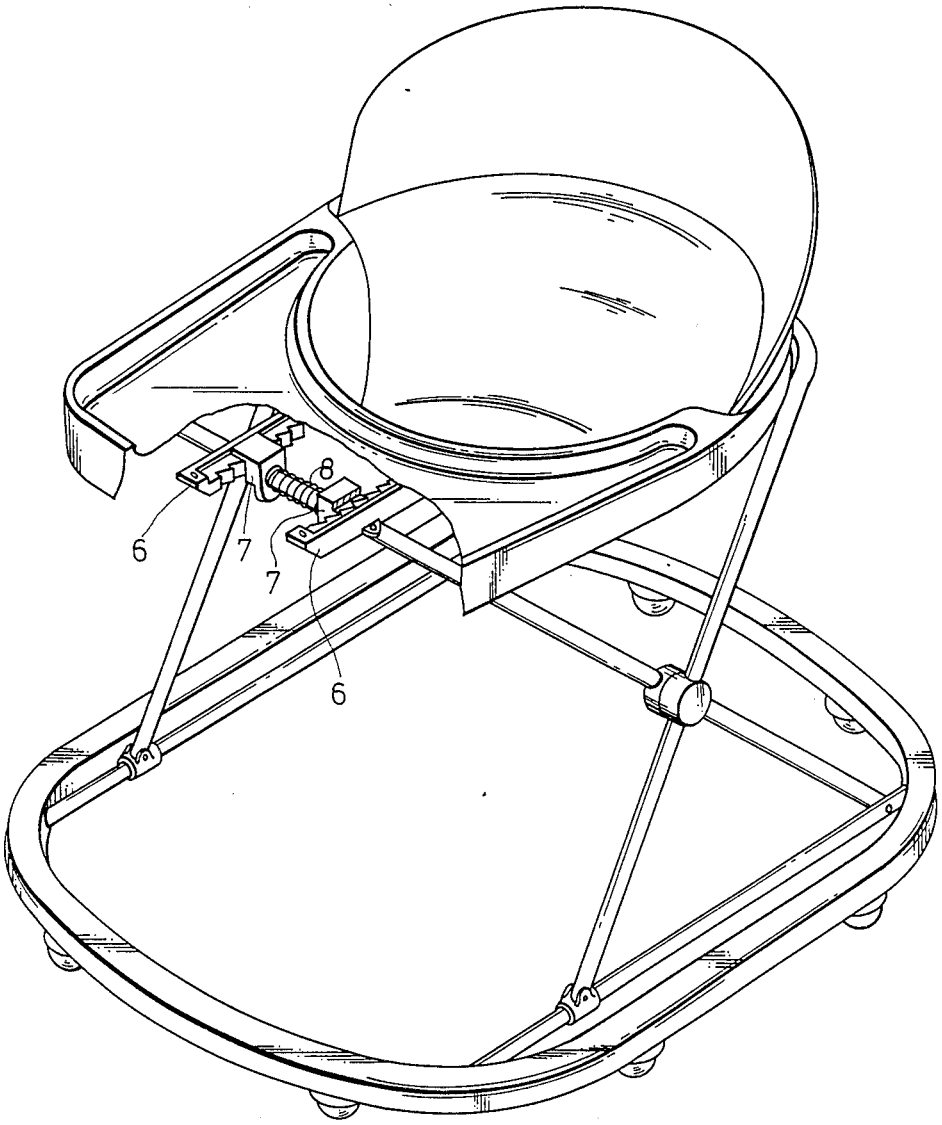
PRIOR ART FIG. 3
FIG. 3 is a perspective view of another conventional walker which is adjustable in height, with portions broken away to reveal constructional details.
Figure 4:
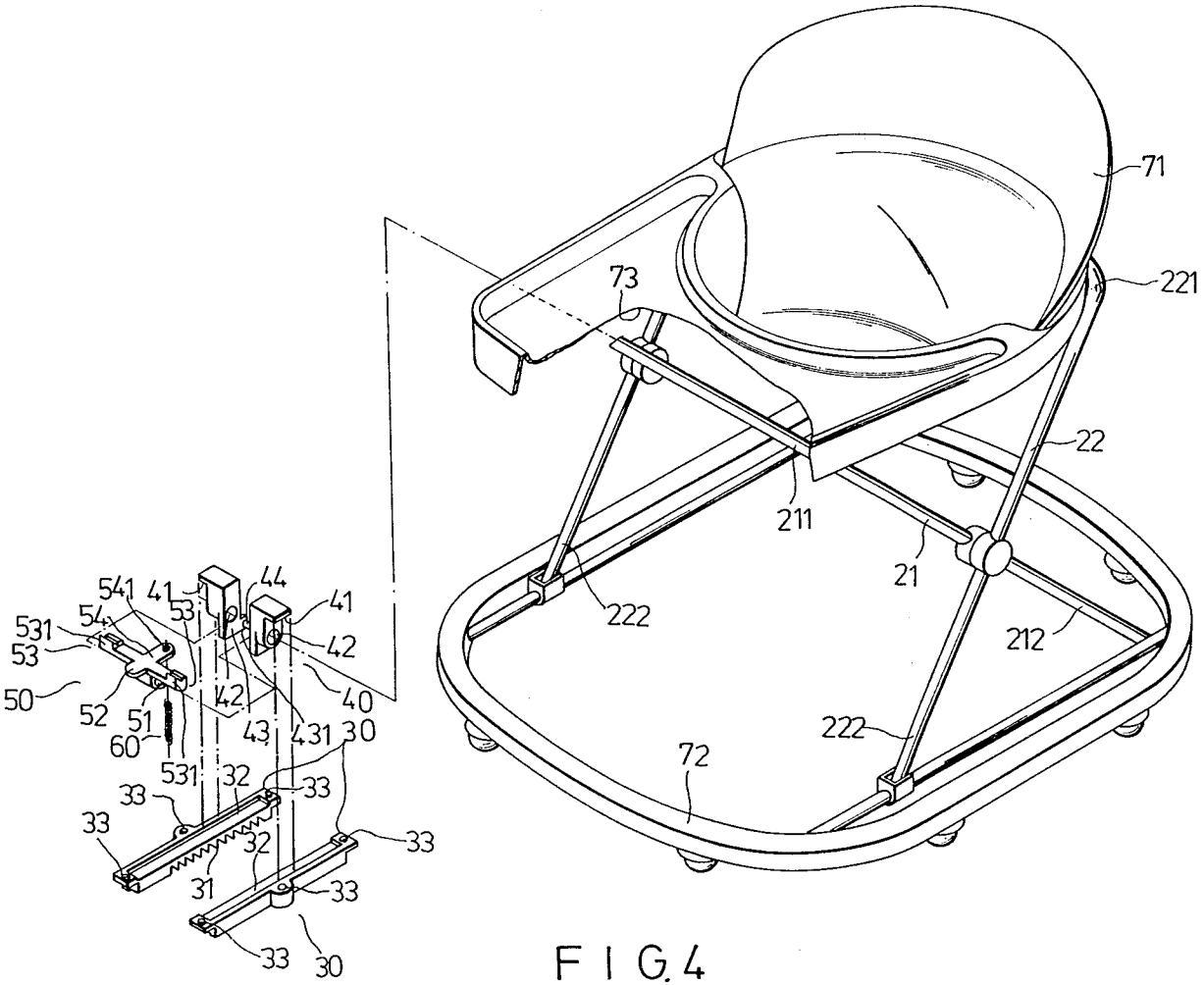
FIG. 4 is a perspective view of a walker according to one preferred embodiment of the present invention, with portions broken away and the adjusting apparatus portion exploded to reveal constructional details.

Referring first to FIG. 4, a walker includes a seat 71, a slidable base 72 under which a plurality of wheels are provided, and two U-shaped tubes 21 and 22 which are pivotally connected to each other in a crosswise arrangement and are placed between the seat 71 and the slidable base 72 with their ends pivotally connected to the slidable base 72 respectively, with the central portion 221 of the tube 22 pivotally connected to the back of the seat 71, and the central portion 211 of the tube 21 movably engaged to the underside 73 of the opposite front side of the seat 71 through an adjusting apparatus in the manner hereinafter described.

The adjusting apparatus for a walker comprises two plates 30 having respective indented portions 31 formed at their undersides, two sliding members 40, a controlling member 50, and a spring member 60. The plates 30 are secured on the underside 73 of the seat 71 in a parallel arrangement by several screws (not shown) screwed through the corresponding holes 33. Each plate 30 has a groove 32 thereon extended inwards through its sidewall, and preferably on its top as shown in FIG. 4. The sliding members 40 have respective openings 42 therethrough for sleeving on the central portion 211 of the tube 21, respective upper extension portions 41 extended into the grooves 32 of the plates 30, and respective lower extension portions 43 having respective apertures 431 thereon. A rod 44 is fixed between the apertures 431 of the lower extension portions 43, and serves to separate the two sliding members 40 with an appropriate distance, so that the sliding members 40 can be maintained at the position between the plates 30 with their upper extension portions 41 slidably resting on the grooves 32 respectively.

The controlling member 50 has an opening 51 therethrough for sleeving it onto the central portion 211 and between the sliding members 40, an operating portion 52 extended forwards, an engaging portion 54 having a hole 541 thereon extended rearwards, and two arms 53 respectively extended sideways. At the end of each arm 53 a protuberance 531 in triangular shape extended upwards is provided. It should be noted that the shape and the number of the protuberances are not limited to those described above, and any shapes that are in correspondence with the shape of the indented portion 31 and any number may be devised. The spring member 60 is a helical tension type spring, and is arranged with one end fixed in the hole 541 of the engaging portion 54 and the other end fixed on the rod 44. Accordingly, under normal conditions, the spring member 60 will bias the controlling member 50 to rotate with respect to the central portion 211 in a direction such that the protuberances 531 are moved upwards to engage with the indented portion 31 respectively. When the operation portion 52 of the controlling member 50 is manually pressed down, the controlling member will rotate in an opposite direction so that the protuberances 531 are moved downwards to disengage with the indented portion 31 against the bias force of the spring member 60.

Figure 5:
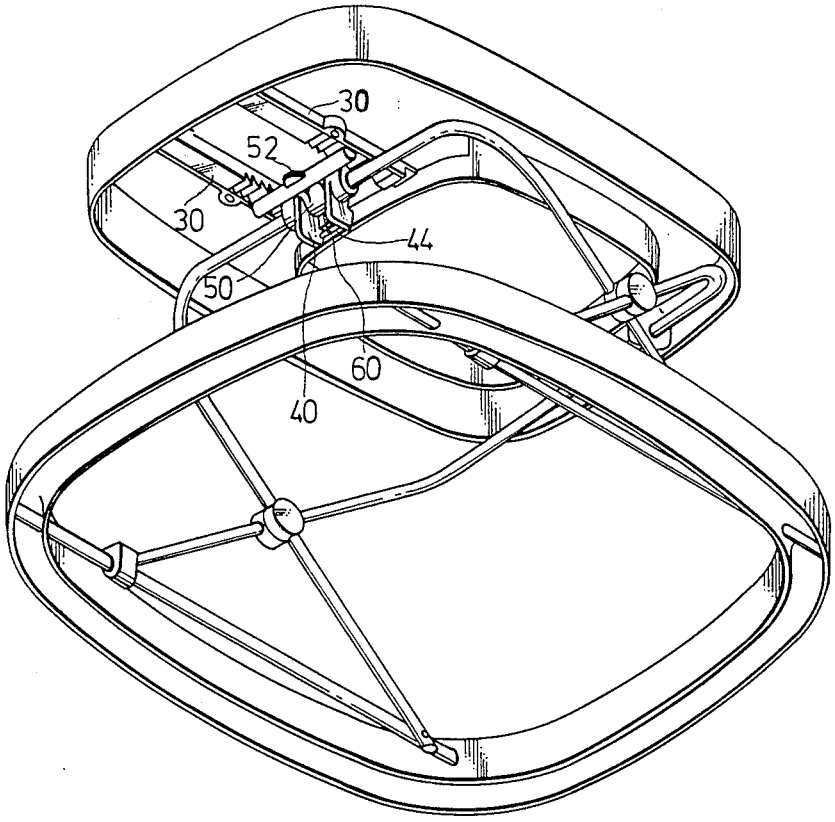
FIG. 5 is a perspective view, as seen from bottom, of the walker with the adjusting apparatus of the present invention shown in FIG. 4.

With reference to FIG. 5, there is shown the adjusting apparatus of the present invention mounted on a walker. In the operation of the adjustment in height, the user can merely use one finger to press the operation portion 52 of the controlling member 50 downwards against the bias force of the spring member 60 for the protuberances 531 to disengage with the indented portion 31, slide the sliding members 40 with the central portion 211 of the U-shaped tube 21 to a desired position, and then release his finger, resulting in that the spring member 60 biases the controlling member 50 to rotate upwards and consequently the protuberances 531 and the indented portions 31 become engaged with on another. According to the structural arrangement of the adjusting apparatus of the present invention, the spring member 60 used therein can be a weaker one, and a strong spring which makes adjustments in the prior art difficult need not be used. Furthermore, when the height adjustment of the walker is accomplished, and when a child sits in the seat 71, the weight of the child will push the seat downwards further asssuring the firm engagement between the protuberances 531 and the indented portions 31. Therefore, according to the structure of the present invention, the walker can still maintain a high degree of stability.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modification and equivalent structures.

What is claimed is:

1. A walker with height adjustment apparatus comprising:

a seat;

a slidable base;

two U-shaped tubes pivotally connected to each other in a crosswise arrangement and disposed between said seat and said slidable base, said U-shaped tubes each having a central portion and ends opposite said central portion, said ends being pivotally connected to said slidable base, said central portion of one of said U-shaped tubes being pivotally connected to one side of said seat, said central portion of the other of said U-shaped tubes being movably engaged to the underside of and opposite side of said seat;

two plates secured on said underside of the opposite side of said seat in a parallel arrangement, with each plate having an indented portion formed at its underside;

two sliding members provided on said movable central portion, and slidably engaged with said plates respectively;

a controlling member pivotally connected with said movable central portion and having an engaging portion with an operating portion opposite to said engaging portion, and two protuberances extended upwards; and a spring member arranged between said sliding members and said engaging portion of said controlling member for biasing said controlling member to rotate in a direction that causes said protuberances to move upwards to engage with said indented portions respectively, and wherein when said operating portion of said controlling member is manually pressed, said controlling member will rotate in the opposite direction so that said protuberances disengage with said indented portions against the bias of said spring member.

2. The walker as claimed in claim 1, wherein said sliding members include a rod connected therebetween for separating said two sliding members with an appropriate distance and for one end of said spring member to be secure thereon.

3. The walker as claimed in claim 2, wherein each plate has a groove thereon, and each sliding member has an extension portion extended to said groove, so that said sliding members along with said movable central portion can slide along said grooves concurrently.

* * * * *